US010291978B2

(12) United States Patent
Fujitani

(10) Patent No.: US 10,291,978 B2
(45) Date of Patent: May 14, 2019

(54) FRAME, SPEAKER UNIT USING THE SAME, AND HEADPHONE/EARPHONE

(71) Applicant: Onkyo Corporation, Osaka (JP)

(72) Inventor: Takeshi Fujitani, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 16/055,045

(22) Filed: Aug. 4, 2018

(65) Prior Publication Data

US 2019/0069073 A1 Feb. 28, 2019

(30) Foreign Application Priority Data

Aug. 25, 2017 (JP) ..... 2017-162535

(51) Int. Cl.

| | |
|---|---|
| ***H04R 1/10*** | (2006.01) |
| ***H04R 1/28*** | (2006.01) |
| ***H04R 5/04*** | (2006.01) |
| ***H04R 7/16*** | (2006.01) |
| ***H04R 9/02*** | (2006.01) |
| ***H04R 9/04*** | (2006.01) |
| ***H04R 31/00*** | (2006.01) |
| ***H04R 5/033*** | (2006.01) |

(52) U.S. Cl.

CPC ..... *H04R 1/1075* (2013.01); *H04R 1/2807* (2013.01); *H04R 5/033* (2013.01); *H04R 5/04* (2013.01); *H04R 7/16* (2013.01); *H04R 9/025* (2013.01); *H04R 9/045* (2013.01); *H04R 31/006* (2013.01); *H04R 2307/025* (2013.01)

(58) Field of Classification Search

CPC .... H04R 1/1075; H04R 1/2807; H04R 5/033; H04R 5/04; H04R 7/16; H04R 9/025; H04R 9/045; H04R 31/006; H04R 2307/025

USPC ..... 381/423

See application file for complete search history.

(56) References Cited

U.S. PATENT DOCUMENTS 5,682,132 A * 10/1997 Hiroyoshi ..... G08B 6/00 310/29
6,127,750 A * 10/2000 Dadd ..... F04B 35/045 310/13
6,377,145 B1 * 4/2002 Kumagai ..... H04R 7/16 310/29

(Continued)

FOREIGN PATENT DOCUMENTS

JP H04-038633 Y 9/1992
JP 4258510 B 4/2009

*Primary Examiner* — Sean H Nguyen
(74) *Attorney, Agent, or Firm* — Renner Otto Boisselle & Sklar, LLP

(57) ABSTRACT

There are provided a headphone and an electrodynamic speaker unit exhibiting proper vibration characteristics and excellent reproduced sound quality. First, second, and third coupling portions of a frame of the headphone defining adjacent two opening holes extend from a magnetic circuit fixing portion to a diaphragm fixing portion such that each of the first, second, and third coupling portions is inclined with respect to a radial line passing through a center point, and are formed such that a first separation distance between the first coupling portion and the second coupling portion and a second separation distance between the second coupling portion and the third coupling portion in a circumferential direction are different from each other and that the opening hole areas of at least two opening holes are unequal to each other.

7 Claims, 5 Drawing Sheets

(56) References Cited

U.S. PATENT DOCUMENTS

| | | | | |
|---|---|---|---|---|
| 7,194,287 | B2 * | 3/2007 | Usuki | H04R 11/06 340/388.4 |
| 7,557,474 | B2 * | 7/2009 | Kuwabara | B06B 1/045 310/21 |
| 7,591,344 | B2 | 9/2009 | Fujitani | |
| 7,961,553 | B2 * | 6/2011 | Kang | H04R 1/24 367/182 |
| 8,130,086 | B2 * | 3/2012 | Choi | H02K 33/16 310/14 |
| 9,234,554 | B2 * | 1/2016 | Dadd | F16F 1/027 |
| 2002/0027491 | A1 * | 3/2002 | Kim | B06B 1/045 335/266 |
| 2005/0147272 | A1 * | 7/2005 | Hyre | H04R 9/06 381/398 |
| 2009/0285417 | A1 * | 11/2009 | Shin | H04M 1/03 381/151 |
| 2010/0054501 | A1 * | 3/2010 | Choi | H04R 9/06 381/151 |
| 2011/0249858 | A1 * | 10/2011 | Lee | H04R 9/066 381/398 |
| 2014/0056459 | A1 * | 2/2014 | Oishi | H04R 31/00 381/370 |
| 2016/0277821 | A1 * | 9/2016 | Kunimoto | H04R 5/033 |
| 2018/0103309 | A1 * | 4/2018 | Ozawa | H04R 1/1008 |

* cited by examiner

FRAME, SPEAKER UNIT USING THE SAME, AND HEADPHONE/EARPHONE

BACKGROUND OF THE INVENTION

1. Field of the Invention

The present invention relates to a frame of an electrodynamic speaker unit used for a headphone/earphone attached to a user's ear to reproduce audio, and specifically relates to a frame configured such that a damping member is attached with a diaphragm and a magnetic circuit being fixed and a speaker unit having the frame.

2. Description of the Related Art

A headphone includes a speaker unit, a housing surrounding a backside of the speaker unit, and an ear contact portion provided on a front side of the speaker unit. The headphone described herein includes not only headphones configured such that a pair of right and left housings is coupled with a headband etc., but also an earphone type headphone configured such that a housing is directly supported on a user's ear and a so-called headset configured such that a housing includes a microphone device.

The headphone is configured to apply an audio signal to the speaker unit closely arranged to contact the user's ear, thereby reproducing sound from a diaphragm. When the speaker unit is driven by the applied audio signal, members forming a frame and a housing of the speaker unit vibrate due to reaction of driving of the speaker unit, and sound is emitted from each member.

As in the case of a frame of a speaker system or a wood speaker cabinet, a frame and a housing of the headphone vibrate with specific natural frequencies depending on materials, dimensions/thicknesses, etc. of these components, and for this reason, unique sound is emitted according to component configuration. Thus, it has been demanded for these members to exhibit a high internal loss and excellent mechanical characteristics in a balanced manner, to be lightweight, and to exhibit excellent heat resistance and S/N ratio.

For example, a typical acoustic equipment peripheral component contains polyphenylene ether-based resin (A), polystyrene-based resin (B), and at least one polyolefin-based resin (C) selected from a group consisting of polyethylene, polypropylene, and ethylene-propylene copolymer, the acoustic equipment peripheral component being used as at least one selected from a horn, a field cover, an equalizer, an equalizer support body, and a speaker front attachment plate (Japanese Patent No. 4258510).

The sound emitted due to vibration of each section forming the frame or the housing of the speaker unit has a lower sound pressure level than that of the sound reproduced from the diaphragm of the speaker unit. However, in the headphone arranged close to the ear, influence of such sound on reproduced sound quality is great. For this reason, selection of the material forming the frame or the housing of the speaker unit, the shape of the housing, etc. have been typically devised.

In some headphones, a damping member having an air permeable frame or housing of a speaker unit and configured such that a sound wave emitted from a diaphragm passes through the damping member is provided. With the damping member, characteristics of an acoustic equivalent circuit including the speaker unit and the housing in the headphone are changed, and sound pressure frequency characteristics etc. are improved. The damping member of the headphone mainly includes a member exhibiting air permeability so that air permeability (the flow rate of air) of an opening hole of the frame through which the sound wave emitted from the diaphragm to a front or back side thereof passes can be adjusted.

For example, in a typical technique, openings are provided at multiple spots of a back side of a diaphragm of a headphone unit as an electrodynamic speaker unit, and damping fabric as a damping material exhibiting air permeability is bonded to the openings to adjust the amount of air passing from the diaphragm to the back side (JP-UM-A-61-109287). Further, JP-UM-A-61-109287 also discloses a headphone configured such that through-holes are provided at a terminal substrate to perform acoustic damping.

Material selection of the damping member and setting of the through-holes in the speaker unit used for the headphone change characteristics of an acoustic circuit in the headphone. This provides great influence not only on basic sound pressure frequency characteristics but also on reproduced sound quality of the headphone. For this reason, there is a problem that the frame is easily vibratable due to a large opening hole of the frame of the speaker unit in the headphone.

The present invention has been made to solve the above-described problem of the typical technique. An object of the present invention relates to a frame of an electrodynamic speaker unit used for a headphone/earphone, and is to provide a headphone and a speaker unit exhibiting proper vibration characteristics and providing excellent reproduced sound quality specifically in the case of a large opening hole due to use of a damping member.

SUMMARY OF THE INVENTION

The frame of the present invention is a frame forming an electrodynamic speaker unit used for a headphone or an earphone. The frame includes a substantially circular ring-shaped diaphragm fixing portion for fixing an outer peripheral portion of a diaphragm, a substantially circular ring-shaped magnetic circuit fixing portion for fixing a magnetic circuit, coupling portions coupling the diaphragm fixing portion and the magnetic circuit fixing portion to define multiple opening holes, and a terminal fixing portion for fixing a terminal, the terminal fixing portion being provided to protrude to an outer peripheral side of the diaphragm fixing portion. First, second, and third coupling portions of the coupling portions defining adjacent two of the opening holes extend from the magnetic circuit fixing portion to the diaphragm fixing portion such that each of the first, second, and third coupling portions is inclined with respect to a radial line passing through a center point, and are formed such that a first separation distance between the first coupling portion and the second coupling portion and a second separation distance between the second coupling portion and the third coupling portion in a circumferential direction are different from each other and that the opening hole areas of at least two of the opening holes are unequal to each other.

Preferably, in the frame of the present invention, multiple groups of at least the first, second, and third coupling portions of the coupling portions are arranged rotationally symmetrically about the center point.

Moreover, in the frame of the present invention, a common coupling portion is shared as the third coupling portion of one of adjacent two of the groups and the first coupling portion of the other one of the adjacent two of the groups.

Preferably, in the frame of the present invention, at least the first and second coupling portions of the coupling portions are formed to curve from the magnetic circuit fixing portion to the diaphragm fixing portion such that the thicknesses thereof gradually become thicker or thinner, and are formed such that the thickness of the first coupling portion and the thickness of the second coupling portion are different from each other.

Preferably, the frame of the present invention is made of a resin material containing polyphenylene ether-based resin, polystyrene-based resin, and at least one polyolefin-based resin selected from a group consisting of polyethylene, polypropylene, and ethylene-propylene copolymer.

Moreover, the speaker unit of the present invention includes the above-described frame, the diaphragm fixed to the diaphragm fixing portion, a voice coil coupled to the diaphragm, the terminal fixed to the terminal fixing portion and connected to a coil of the voice coil, the magnetic circuit having a magnetic gap in which the coil of the voice coil is arranged and fixed to the magnetic circuit fixing portion, and a damping member attached to cover the opening holes.

Further, the headphone or the earphone of the present invention includes the above-described speaker unit.

Hereinafter, advantageous effects of the present invention will be described.

The frame of the present invention is the frame forming the electrodynamic speaker unit used for the headphone or the earphone, and further includes the diaphragm, the voice coil, the terminal, the magnetic circuit, and the damping member to form the electrodynamic speaker unit. The frame includes the substantially circular ring-shaped diaphragm fixing portion for fixing the outer peripheral portion of the diaphragm, the substantially circular ring-shaped magnetic circuit fixing portion for fixing the magnetic circuit, the coupling portions coupling the diaphragm fixing portion and the magnetic circuit fixing portion to define the multiple opening holes, and the terminal fixing portion for fixing the terminal, the terminal fixing portion being provided to protrude to the outer peripheral side of the diaphragm fixing portion.

In the frame, the first, second, and third coupling portions of the coupling portions defining adjacent two of the opening holes extend from the magnetic circuit fixing portion to the diaphragm fixing portion such that each of the first, second, and third coupling portions is inclined with respect to the radial line passing through the center point, and are formed such that the first separation distance between the first coupling portion and the second coupling portion and the second separation distance between the second coupling portion and the third coupling portion in the circumferential direction are different from each other. Thus, the opening hole areas of at least two of the opening holes are formed unequal to each other. Moreover, in the frame, the multiple groups of the first, second, and third coupling portions of the coupling portions are arranged rotationally symmetrically about the center point.

As a result, adjacent opening holes are formed with different opening hole areas by the coupling portions in the frame, and therefore, a structure of the frame including the diaphragm fixing portion and the magnetic circuit fixing portion is not uniform. Thus, dispersion of the resonance frequency of vibration can easily occurs, and emitted sound having a noticeable peak due to vibration caused in a typical case where opening holes with a uniform opening hole area are formed can be relatively reduced. Thus, the frame can provide excellent reproduced sound quality of the headphone or the earphone. Moreover, the opening holes can be uniformly provided across the circumferential direction, and therefore, a failure such as rolling of the diaphragm or occurrence of noise can be reduced.

Note that the first, second, and third coupling portions of the frame may share the third coupling portion of one of adjacent two of the groups and the first coupling portion of the other one of the adjacent two of the groups. Further, the first and second coupling portions of the coupling portions may be formed to curve from the magnetic circuit fixing portion to the diaphragm fixing portion such that the thicknesses thereof gradually become thicker or thinner, and may be formed such that the thickness of the first coupling portion and the thickness of the second coupling portion are different from each other. As a result, sound emitted due to vibration of the frame is reduced, and the headphone or the earphone including the speaker unit having the frame of the present invention exhibits proper acoustic characteristics and provides excellent reproduced sound quality.

Note that the above-described frame of the present invention is preferably made of the resin material containing the polyphenylene ether-based resin, the polystyrene-based resin, and at least one polyolefin-based resin selected from the group consisting of the polyethylene, the polypropylene, and the ethylene-propylene copolymer. The headphone with excellent reproduced sound quality can be configured.

The frame of the electrodynamic speaker unit used for the headphone/earphone according to the present invention can provide a headphone and a speaker unit exhibiting proper vibration characteristics and providing excellent reproduced sound quality even in the case of a large opening hole due to use of a damping member.

DETAILED DESCRIPTION OF THE PREFERRED EMBODIMENTS

Hereinafter, a frame, a speaker unit using the frame, and a headphone/earphone according to preferred embodiments of the present invention will be described, but the present invention is not limited to these embodiments.

Figure 1:
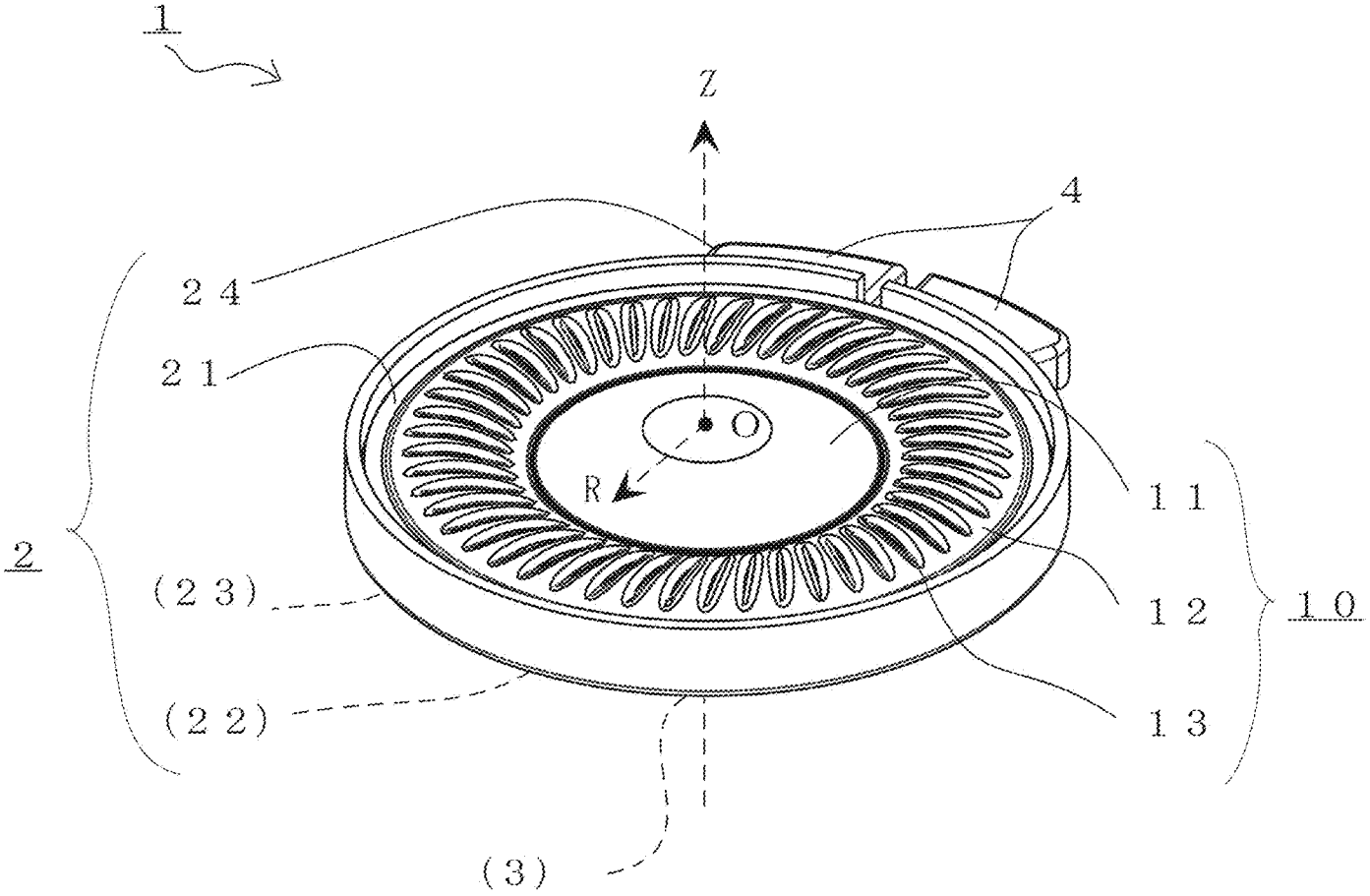
FIG. 1 is an external view of an electrodynamic speaker unit used for a headphone/earphone according to one embodiment of the present invention.
Figure 2:
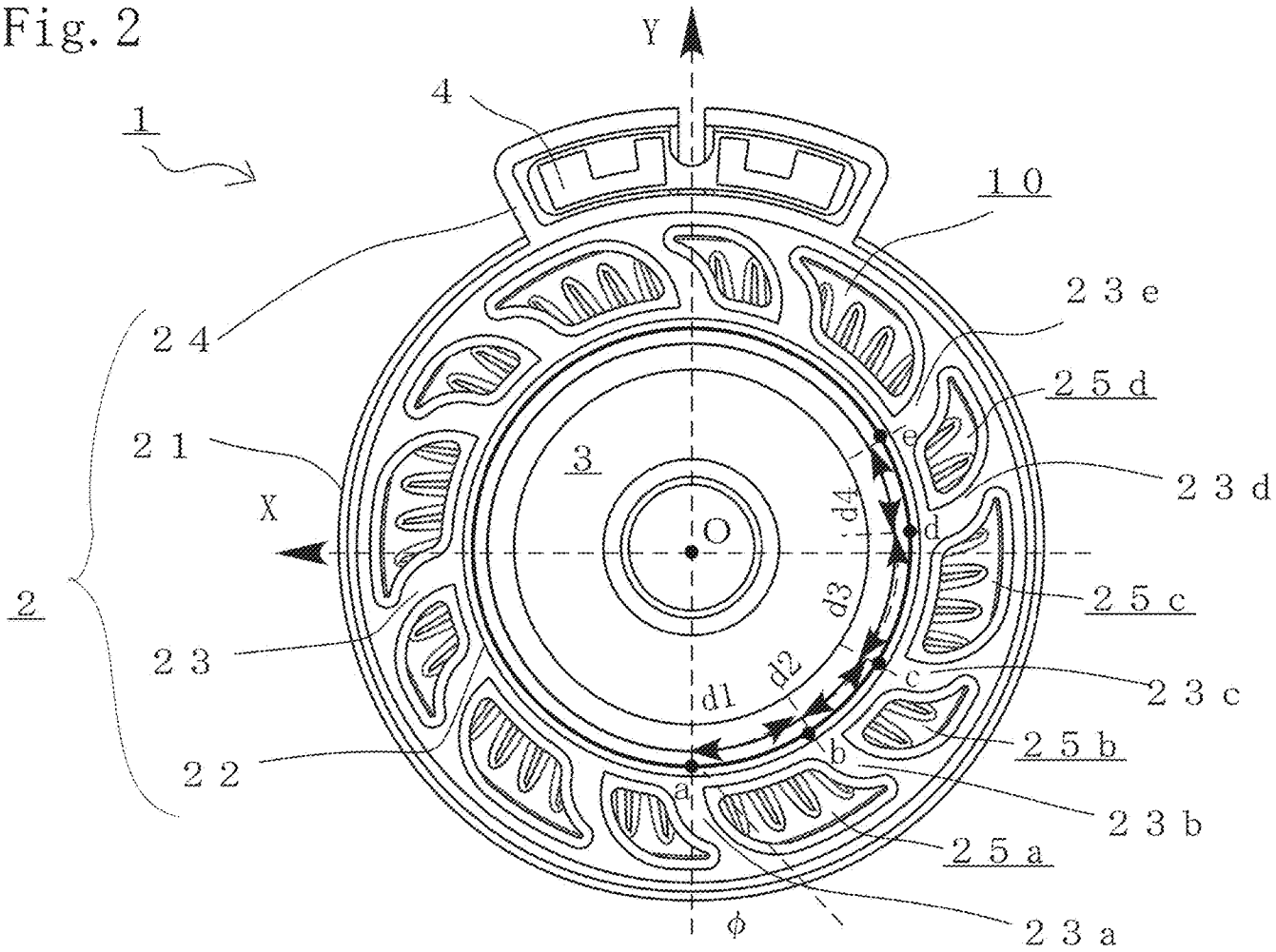
FIG. 2 is a view for describing a specific structure of the speaker unit according to one embodiment of the present invention.

FIG. 1 or FIG. 2 is a view for describing an electrodynamic speaker unit 1 used for a headphone/earphone according to a preferred embodiment of the present invention. Specifically, FIG. 1 is a perspective view of an outer appearance of the speaker unit 1 from a front side, and FIG. 2 is a view of the speaker unit 1 from a back side. Note that the form of the speaker unit 1 is not limited to that in the case of the present embodiment. Moreover, configurations of the speaker unit 1 unnecessary for description of the present invention will not be illustrated and described.

The speaker unit 1 of the present embodiment is a compact electrodynamic speaker used for a headphone/earphone arranged close to a user's ear and having a nominal diameter of 40 mm. Note that the speaker unit 1 is attached to a cavity of the headphone or a body of the earphone to form the headphone or the earphone. Note that a specific form of the headphone or the earphone using the speaker unit 1 will not be illustrated and described.

The speaker unit 1 includes a frame 2 made of a resin material, a magnetic circuit 3 fixed to the frame 2, a diaphragm 10 molded from a film-shaped polyethylene terephthalate (PET) member, a voice coil (not shown) coupled to the diaphragm 10 and having a coil arranged in a magnetic gap (not shown) of the magnetic circuit 3, terminals 4 connected to both ends of the coil of the voice coil, and a damping member (not shown) attached to the frame 2 such that a sound wave emitted from the diaphragm 10 passes through the damping member. Note that the damping member covering later-described opening holes 25 of the frame 2 are not shown in FIG. 2, and therefore, the back side of the diaphragm 10 is visible through the opening holes 25.

The diaphragm 10 is a diaphragm configured such that a dome portion 11 as in part of a spherical surface and an edge portion 12 extending at the outer periphery of the dome portion 11 are integrally formed. The voice coil to which audio signal current is supplied from the back side is attached to a joint portion to the edge portion 12 at an outer peripheral portion of the dome portion 11. An outer peripheral end side of the edge portion 12 of the diaphragm 10 is fixed to a diaphragm fixing portion 21 of the frame 2, and the compact lightweight magnetic circuit 3 is fixed to a magnetic circuit fixing portion 22 of the frame 2. An opening hole communicating with the magnetic gap of the magnetic circuit 3 and configured such that the voice coil passes through the opening hole is provided inside the magnetic circuit fixing portion 22. The coil of the voice coil coupled to the diaphragm 10 is arranged in the magnetic gap of the magnetic circuit 3.

Thus, when the audio signal current is supplied to the voice coil arranged in the magnetic gap of the magnetic circuit 3 where a strong DC magnetic field is generated, drive force is, in the speaker unit 1, generated in an illustrated Z-axis direction, and a speaker vibration system including the voice coil and the diaphragm 10 vibrates in the Z-axis direction. That is, the speaker vibration system is vibratably supported only by the edge portion 12 of the diaphragm 10. As a result, a pressure change occurs in air present around the diaphragm 10, and the audio signal current is converted into a sound wave (audio).

The edge portion 12 of the diaphragm 10 is a roll edge of which section in a radial direction is in a raised shape, and multiple recessed ribs 13 formed by denting of the raised surface are provided. Each recessed rib 13 is provided in an inclined direction with respect to the radial direction R (or X or Y) passing through the center point O. In the present embodiment, 48 recessed ribs 13 are rotationally symmetrical about the center point O at the edge portion 12. The recessed ribs 13 improve upper-to-lower symmetry of the diaphragm 10, prevent a failure such as rolling of the diaphragm 10 or occurrence of noise, and improve reproduced sound quality.

The frame 2 has the substantially circular ring-shaped diaphragm fixing portion 21 for fixing an outer peripheral portion of the edge portion 12 of the diaphragm 10, the substantially circular ring-shaped magnetic circuit fixing portion 22 for fixing the magnetic circuit 3, coupling portions 23 for coupling the diaphragm fixing portion 21 and the magnetic circuit fixing portion 22 and defining the multiple opening holes 25, and a terminal fixing portion 24 provided, for fixing the terminals 4, to protrude to an outer peripheral side of the diaphragm fixing portion 21. The frame 2 is configured such that the diaphragm 10 is attached with the dome portion 11 and the edge portion 12 being exposed on the front side to reproduce a sound wave emitted from the front side of the diaphragm 10.

Further, for a sound wave emitted from the back side of the diaphragm 10 in a reverse-phase relationship with the sound wave emitted from the front side of the diaphragm 10, the frame 2 is configured such that a sound wave from the edge portion 12 is reproduced on the back side through the multiple opening holes 25 defined by the coupling portions 23. The damping member (not shown) exhibiting air permeability can be attached to the coupling portions 23 to cover the opening holes 25. The speaker unit 1 can adjust, in accordance with the headphone or the earphone, the compliance (the acoustic capacity) of an inner space of the frame 2 by the opening holes 25 and the damping member. With the adjusted compliance, frequency characteristics, specifically low frequency characteristics, can be adjusted.

As illustrated in FIG. 2, 12 coupling portions 23 of the frame 2 are provided to extend from the magnetic circuit fixing portion 22 to the diaphragm fixing portion 21 such that each coupling portion 23 is inclined with respect to the radial line passing through the center point O. Thus, in the case of the present embodiment, 12 opening holes 25 are defined in a circumferential direction by the coupling portions 23. Moreover, the coupling portions 23 of the frame 2 are arranged rotationally symmetrically about the center point O. In the frame 2, the terminal fixing portion 24 for fixing the terminals 4 is provided to protrude to the outer peripheral side of the diaphragm fixing portion 21, and therefore, the opening holes 25 can be uniformly provided across the circumferential direction of the frame 2.

Hereinafter, the frame 2 will be first described with reference to a portion including each of opening holes 25*a* to 25*d* between adjacent ones of coupling portions 23*a* to 23*e* of the frame 2. The coupling portion 23*a* extends from a reference point a on the magnetic circuit fixing portion 22 to the diaphragm fixing portion 21 in such an inclined direction that the coupling portion 23*a* is inclined at an angle φ with respect to the radial line Y passing through the center point O. The coupling portion 23*a* is formed to curve from the magnetic circuit fixing portion 22 to the diaphragm fixing portion 21 such that the thickness thereof gradually becomes thinner.

Next, the coupling portion 23*b* adjacent to the coupling portion 23*a* extends, in the inclined direction, from a reference point b apart from the reference point a on the magnetic circuit fixing portion 22 by a first separation distance d1 in the circumferential direction to the diaphragm fixing portion 21. As in the coupling portion 23*a*, the coupling portion 23*b* is formed to curve from the magnetic circuit fixing portion 22 to the diaphragm fixing portion 21 such that the thickness thereof gradually becomes thinner. Thus, the substantially trapezoidal opening hole 25*a* having an area corresponding to the first separation distance d1 is defined between the coupling portion 23*a* and the coupling portion 23*b*.

Further, the coupling portion 23*c* adjacent to the coupling portion 23*b* extends, in the inclined direction, from a reference point c apart from the reference point b on the magnetic circuit fixing portion 22 by a second separation distance d2 in the circumferential direction to the diaphragm fixing portion 21. Moreover, the coupling portion 23*c* is rotationally symmetrical to the coupling portion 23*a* about the center point O. Thus, as in the coupling portion 23*a* or the coupling portion 23*b*, the coupling portion 23*c* is also formed to curve from the magnetic circuit fixing portion 22 to the diaphragm fixing portion 21 such that the thickness thereof gradually becomes thinner. Thus, the substantially trapezoidal opening hole 25*b* having an area corresponding to the second separation distance d2 is defined between the coupling portion 23*b* and the coupling portion 23*c*. As illustrated in FIG. 2, the second separation distance d2 as a distance between the reference point b and the reference point c is shorter than the first separation distance d1 as a distance between the reference point a and the reference point b, and therefore, the area of the opening hole 25*b* is different from that of the opening hole 25*a*, i.e., is smaller than that of the opening hole 25*a*.

Further, the coupling portion 23*d* adjacent to the coupling portion 23*c* extends, in the inclined direction, from a reference point d apart from the reference point c on the magnetic circuit fixing portion 22 by a third separation distance d3 in the circumferential direction to the diaphragm fixing portion 21. Moreover, the coupling portion 23*d* is rotationally symmetrical to the coupling portion 23*b* about the center point O. Thus, as in the coupling portions 23*a* to 23*c*, the coupling portion 23*d* is also formed to curve from the magnetic circuit fixing portion 22 to the diaphragm fixing portion 21 such that the thickness thereof gradually becomes thinner. Thus, the substantially trapezoidal opening hole 25*c* having an area corresponding to the third separation distance d3 is defined between the coupling portion 23*c* and the coupling portion 23*d*. Moreover, the first separation distance d1 and the third separation distance d3 are set equal to each other. Thus, the area of the opening hole 25*c* is equal to that of the opening hole 25*a*, and is larger than that of the opening hole 25*b*.

Further, the coupling portion 23*e* adjacent to the coupling portion 23*d* extends, in the inclined direction, from a reference point e apart from the reference point d on the magnetic circuit fixing portion 22 by a fourth separation distance d4 in the circumferential direction to the diaphragm fixing portion 21. Moreover, the coupling portion 23*e* is rotationally symmetrical to the coupling portion 23*a* or the coupling portion 23*c* about the center point O. Thus, as in the coupling portions 23*a* to 23*d*, the coupling portion 23*e* is also formed to curve from the magnetic circuit fixing portion 22 to the diaphragm fixing portion 21 such that the thickness thereof gradually becomes thinner. Thus, the substantially trapezoidal opening hole 25*d* having an area corresponding to the fourth separation distance d4 is defined between the coupling portion 23*d* and the coupling portion 23*e*. Moreover, the second separation distance d2 and the fourth separation distance d4 are set equal to each other. Thus, the area of the opening hole 25*d* is equal to that of the opening hole 25*b*, and is smaller than that of the opening hole 25*a* or the opening hole 25*c*.

That is, as the coupling portions 23 of the frame 2, multiple groups of a first coupling portion such as the coupling portion 23*a*, a second coupling portion such as the coupling portion 23*b*, and a third coupling portion such as the coupling portion 23*c* are arranged rotationally symmetrically about the center point O, and the opening hole areas of two opening holes 25*a*, 25*b* defined by these coupling portions are set unequal to each other. The same applies to two opening holes 25*c*, 25*d* defined by the group of the coupling portion 23*c*, the coupling portion 23*d*, and the coupling portion 23*e*, and the opening hole areas thereof are set unequal to each other. In this case, the coupling portion 23*c* forming one group and the other group of two adjacent groups of the coupling portions 23 is shared.

Thus, at the coupling portions 23 of the frame 2, multiple pairs of opening holes 25*a*, 25*b* having unequal opening hole areas defined by three coupling portions 23 are arranged rotationally symmetrically about the center point O. The coupling portions 23 of the frame 2 are configured such that pairs of opening holes having different opening hole areas are formed as described above. With this configuration, dispersion of the resonance frequency of vibration of the frame 2 including the diaphragm fixing portion 21 and the magnetic circuit fixing portion 22 can easily occur, and emitted sound having a noticeable peak due to vibration caused in a typical case where opening holes with a uniform opening hole area are formed can be relatively reduced.

The frame 2 is made of the resin material containing polyphenylene ether-based resin, polystyrene-based resin, and at least one polyolefin-based resin selected from a group consisting of polyethylene, polypropylene, and ethylene-propylene copolymer. A mass ratio between the polyphenylene ether-based resin and the polystyrene-based resin preferably falls within a range of 90/10 to 70/30, and 5 to 20 parts by weight of the polyolefin-based resin is preferably contained with respect to the total of 100 parts by weight of the polyphenylene ether-based resin and the polystyrene-based resin. The polyphenylene ether-based resin and the polystyrene-based resin may be alloyed.

The above-described resin material is employed, and therefore, the frame 2 of the present embodiment can exhibit a high internal loss and excellent mechanical characteristics in a balanced manner, can be lightweight, and can exhibit excellent heat resistance and S/N ratio. More specifically, the polyphenylene ether-based resin, the polystyrene-based resin, and the polyolefin-based resin are contained with a specific ratio, and therefore, the frame 2 exhibiting a significantly-high internal loss and excellent mechanical characteristics in a balanced manner and exhibiting excellent vibration characteristics without impairing excellent heat resistance, humidity resistance, moldability, dimension stability, and lightweight properties originally possessed by these types of resin can be obtained.

Figure 3:
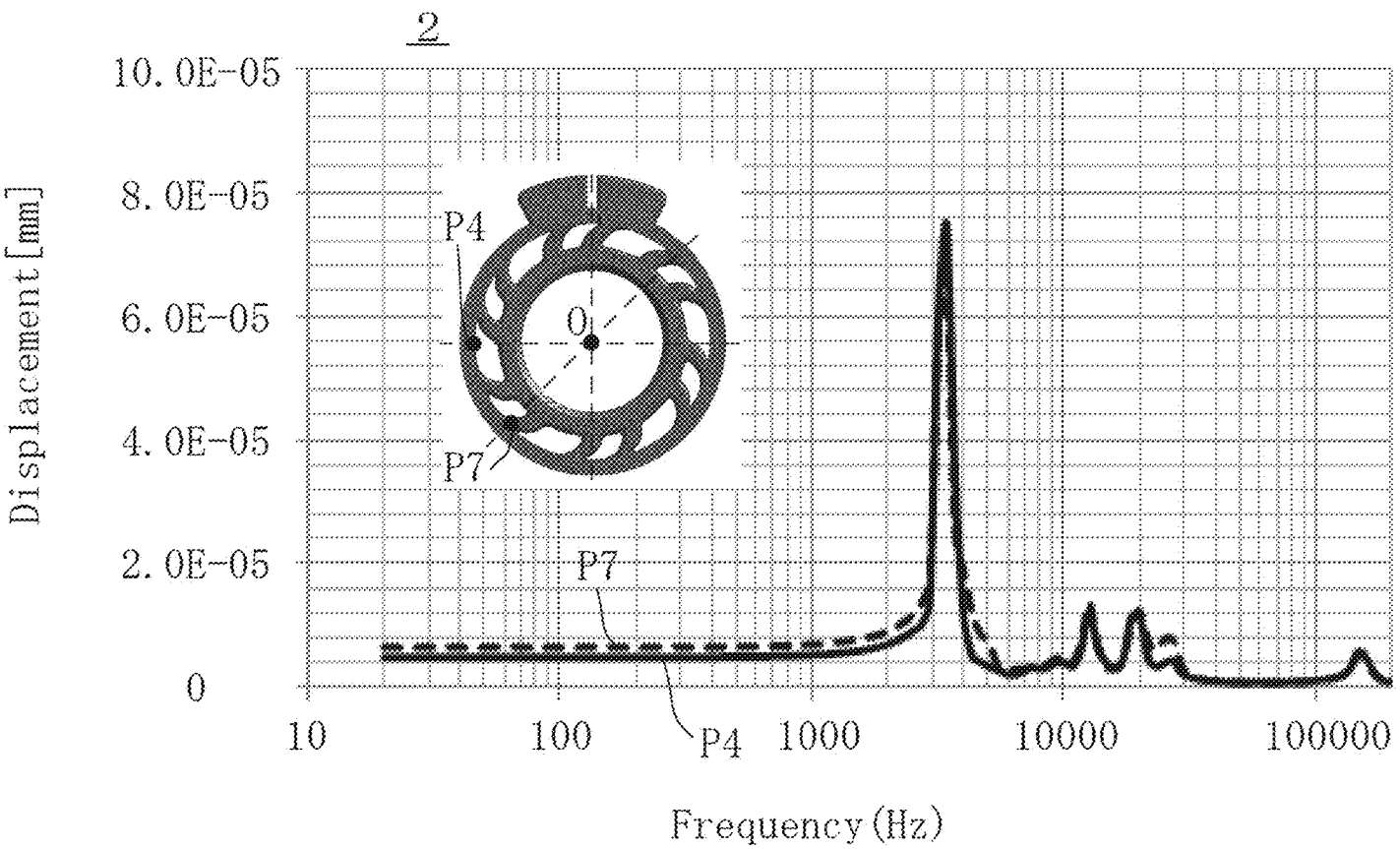
FIG. 3 is a graph of vibration characteristics of a frame according to one embodiment of the present invention.
Figure 4:
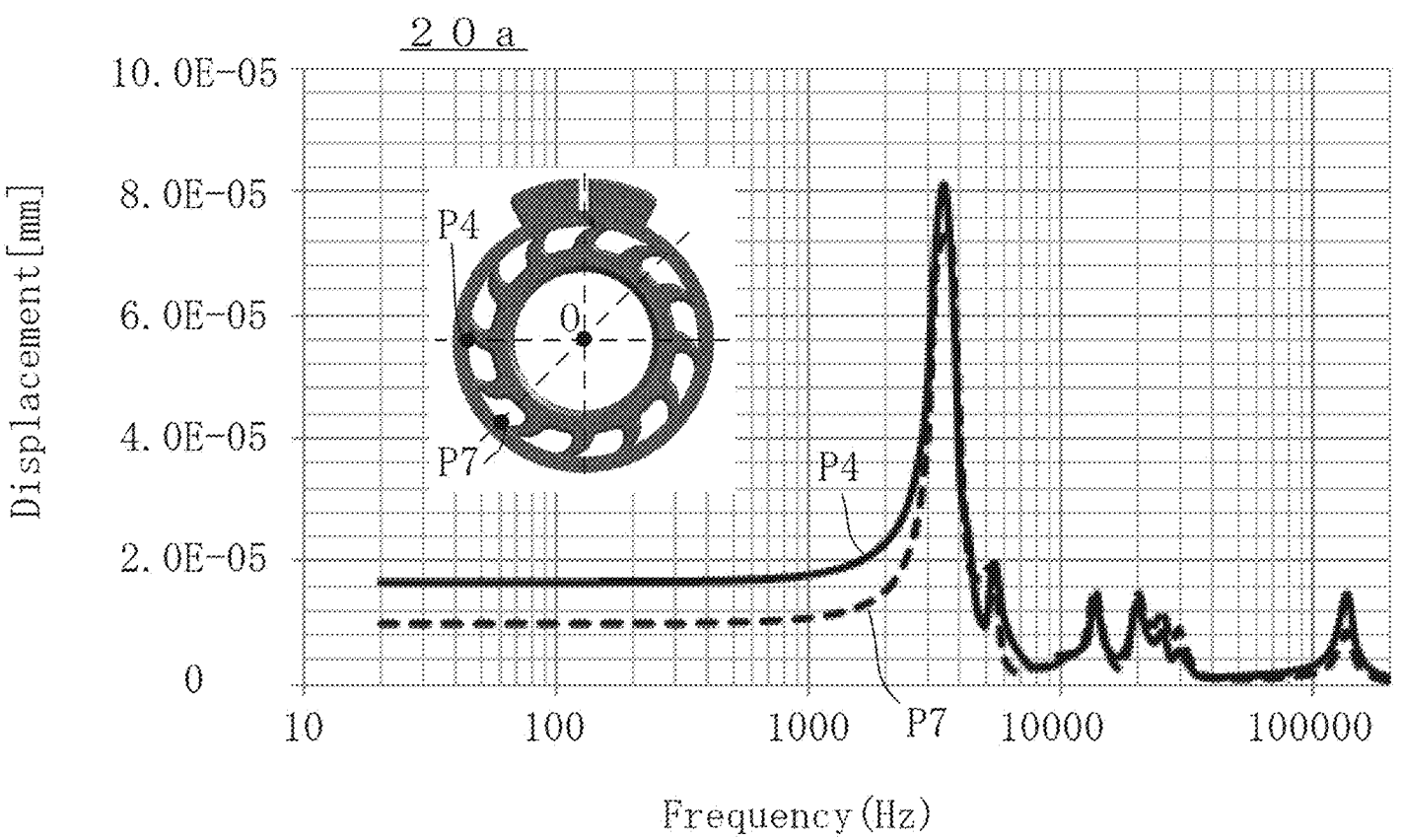
FIG. 4 is a graph of vibration characteristics of a frame of a first comparative example.
Figure 5:
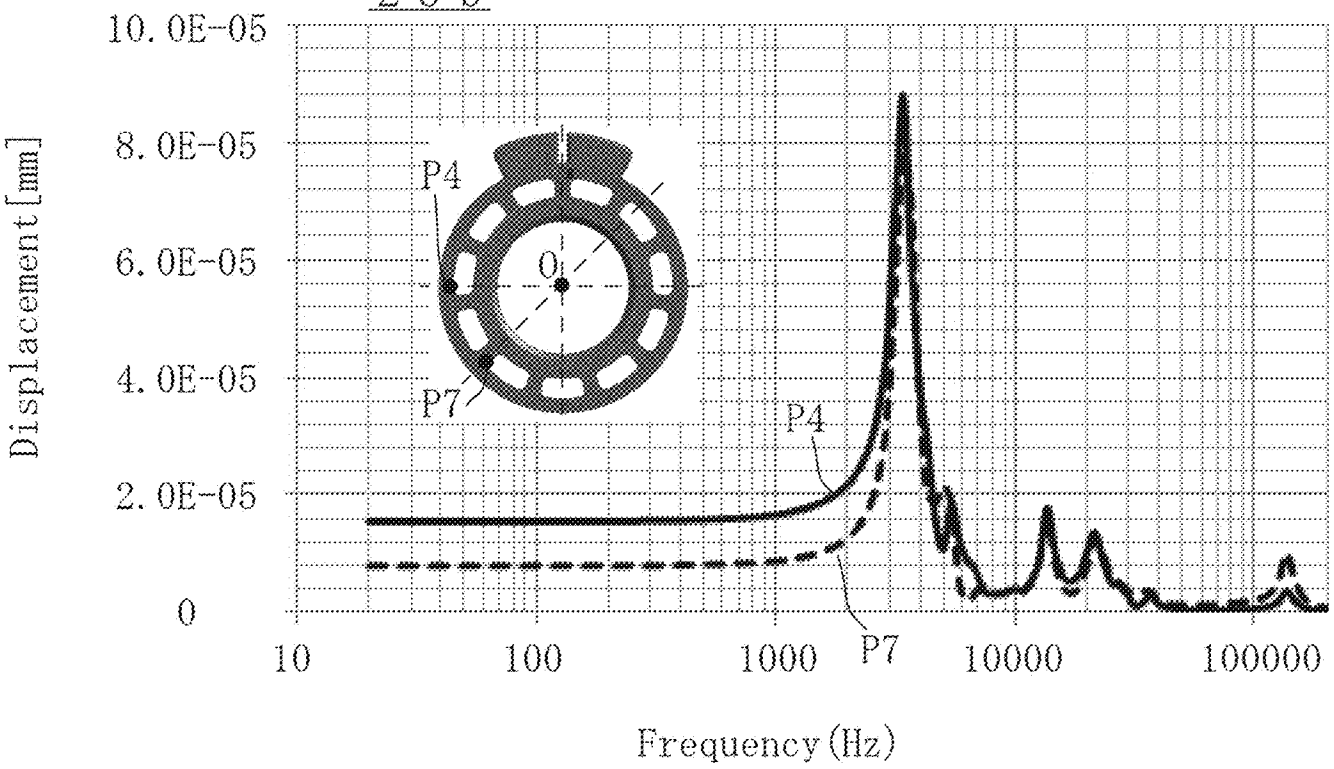
FIG. 5 is a graph of vibration characteristics of a frame of a second comparative example.

FIGS. 3 to 5 are graphs of vibration characteristics of the frame 2 of the present embodiment, a frame 20*a* of a first comparative example, and a frame 20*b* of a second comparative example. As shown in each of these graphs, FIG. 3 shows the case of the frame 2 of the present embodiment, FIG. 4 shows the case of the frame 20*a* of the first comparative example, and FIG. 5 shows the case of the frame 20*b* of the second comparative example. The frames illustrated in FIGS. 3 to 5 are illustrated as front views from the front side on which the diaphragm 10 is attached.

The frame 20*a* of the first comparative example is different from the frame 2 of the present embodiment in that the areas of all opening holes are changed equally, and common settings are applied as other settings. That is, the first, second, and third coupling portions of the coupling portions 23 defining two adjacent opening holes extend from the magnetic circuit fixing portion to the diaphragm fixing portion such that each coupling portion is inclined with respect to the radial line passing through the center point, but are formed such that the first separation distance between the first coupling portion and the second coupling portion and the second separation distance between the second coupling portion and the third coupling portion in the circumferential direction are equal to each other.

On the other hand, the frame 20*b* of the second comparative example is different from the frame 2 of the present embodiment in that the areas of all opening holes are changed equally and all coupling portions 23 extend from the magnetic circuit fixing portion 22 to the diaphragm fixing portion 21 without being inclined with respect to the radial line passing through the center point O, and substantially common settings are applied as other settings. The coupling portions 23 are, without curving from the magnetic circuit fixing portion 22 to the diaphragm fixing portion 21, formed such that the thicknesses thereof do not change according to the distance from the center point O.

Specifically, FIGS. 3 to 5 are graphs of the displacement of vibration in the Z-direction at a representative measurement point P4, P7 of the diaphragm fixing portion 21 shown in the graphs in the case of providing the drive force to the magnetic circuit fixing portion 22 of the frame 2, the horizontal axis representing a frequency and the vertical axis representing a displacement. Thus, the graphs show that a frequency with a greater displacement at the vertical axis of the graph results in more deformation of the frame 2 and that noticeable resonance occurs at a frequency showing a greater peak than those of frequencies therearound. For a frame exhibiting excellent vibration characteristics, the value of the displacement is preferably small at any frequency.

As compared to the frame 20*a* of the first comparative example or the frame 20*b* of the second comparative example, the frame 2 of the present embodiment shows a smaller displacement for a primary resonance mode at around about 3.5 kHz. Moreover, occurrence of a higher resonance mode than such a resonance frequency is also reduced at the frame 2, and the frame 2 shows smaller peaks. These peak levels show a smaller displacement than those of the first or second comparative example. Further, in the frame 2, the displacement at a frequency equal to or lower than the above-described resonance frequency is much smaller than that of the first or second comparative example.

The graphs of FIGS. 3 to 5 show that in a case where the substantially equal opening hole area is provided to the coupling portions 23 of the frame 2, when the coupling portions 23 are formed such that the opening hole areas of adjacent opening holes 25 are different from each other as in the frame 2 of the present embodiment, dispersion of the resonance frequency of vibration of the frame 2 including the diaphragm fixing portion 21 and the magnetic circuit fixing portion 22 can easily occur and the emitted sound due to vibration of the frame 2 can be reduced. Moreover, the frame 2 of the present embodiment has substantially increased strength as compared to that in the case of the frame 20*a* or the frame 20*b*, and therefore, is less deformable.

Thus, the electrodynamic speaker unit 1 using the frame 2 can provide excellent reproduced sound quality of the headphone or the earphone including the electrodynamic speaker unit 1. In the case of the headphone (not shown) including the electrodynamic speaker unit 1 using the frame 2 of the present embodiment, better reproduced sound quality can be, as a result of trial listening as compared to that of a headphone (not shown) of the comparative example, confirmed as compared to the headphone of the comparative example. This is because occurrence of an unnecessary sound wave such as noise from the frame 2 of the electrodynamic speaker unit 1 due to unnecessary vibration can be reduced in the case of the present embodiment. Needless to say, the electrodynamic speaker unit 1 using the frame 2 may be used for the earphone (not shown) configured such that a housing is directly supported on the user's ear.

The above-described resin material containing, with the specific ratio, the polyphenylene ether-based resin, the polystyrene-based resin, and the polyolefin-based resin is employed for the frame 2 of the present embodiment. With this configuration, the frame 2 of the present embodiment can exhibit a high internal loss and excellent mechanical characteristics in a balanced manner, can be lightweight, and can exhibit excellent heat resistance and S/N ratio. However, the frame 2 may be made of other resin materials with different ratios or metal materials.

At the coupling portions 23 of the frame 2 of the present embodiment, multiple pairs of opening holes 25*a*, 25*b* with unequal opening hole areas defined by three coupling portions 23 are arranged rotationally symmetrically about the center point O. However, the groups of the coupling portions 23 of the frame 2 may be configured such that three opening holes with different opening hole areas defined by four adjacent coupling portions 23 are formed. Each group of the coupling portions 23 of the frame 2 may include more coupling portions 23. That is, as long as the groups of the coupling portions 23 of the frame 2 defining the opening holes 25 with different opening hole areas are formed, dispersion of the resonance frequency of vibration of the frame 2 including the diaphragm fixing portion 21 and the magnetic circuit fixing portion 22 can occur, and the emitted sound having the noticeable peak due to vibration can be reduced.

In the case of the present embodiment, 12 coupling portions 23 coupling the diaphragm fixing portion 21 and the magnetic circuit fixing portion 22 of the frame 2 of the present embodiment are formed inclined in the same direction with respect to the radial line passing through the center point O. However, as long as multiple coupling portions 23 are provided, the number of coupling portions 23 may be an odd number, and the coupling portions 23 may include the groups of the coupling portions 23 inclined in different directions of a right-to-left direction with respect to the radial line.

The coupling portions 23 are preferably curved to extend in such an inclined direction that the coupling portions 23 are inclined with respect to the radial line Y passing through the center point O, but may linearly extend from the magnetic circuit fixing portion 22 to the diaphragm fixing portion 21. Moreover, each coupling portion 23 may be formed such that the thickness thereof gradually becomes thicker. The substantially trapezoidal opening hole 25 may be defined between two coupling portions 23. Further, at the frame 2 of the present embodiment, the opening holes 25 are uniformly provided by the coupling portions 23 across the circumferential direction, and therefore, the electrodynamic speaker unit 1 can reduce occurrence of the failure such as rolling of the diaphragm 10 or occurrence of noise.

Note that the resin material forming the diaphragm 10 is not limited to the film-shaped PET member of the above-described embodiment. The material forming the diaphragm 10 may be lightweight films of other resin materials such as polyetheretherketone (PEEK), polyetherimide (PEI), polyethylenenaphthalate (PEN), polycarbonate (PC), polyimide (PI), polyarylate (PAR), and polyphenylene sulfide (PPS), may be formed by hot pressing of a sheet, or may be formed by press molding of an elastomer sheet.

The frame of the present invention is not limited to the electrodynamic speaker unit as illustrated, and may be a frame further including a damper and having a damper attachment portion. Alternatively, the frame of the present invention is not limited to the electrodynamic speaker unit, and is also applicable to an electrodynamic vibrator.

What is claimed is:

1. A frame forming an electrodynamic speaker unit used for a headphone or an earphone, comprising:

a substantially circular ring-shaped diaphragm fixing portion for fixing an outer peripheral portion of a diaphragm;

a substantially circular ring-shaped magnetic circuit fixing portion for fixing a magnetic circuit;

first, second, and third coupling portions each coupling the diaphragm fixing portion and the magnetic circuit fixing portion to define multiple opening holes; and a terminal fixing portion for fixing a terminal, the terminal fixing portion being provided to protrude to an outer peripheral side of the diaphragm fixing portion, wherein the first, second, and third coupling portions extend from the magnetic circuit fixing portion to the diaphragm fixing portion such that each of the first, second, and third coupling portions is inclined with respect to a radial line passing through a center point, and are formed such that a first separation distance between the first coupling portion and the second coupling portion and a second separation distance between the second coupling portion and the third coupling portion in a circumferential direction are different from each other and that opening hole areas of at least two adjacent opening holes among the multiple opening holes are unequal to each other.

2. The frame according to claim 1, wherein multiple groups of at least the first, second, and third coupling portions are arranged rotationally symmetrically about the center point.

3. The frame according to claim 2, wherein a common coupling portion is shared as the third coupling portion of one of adjacent two of the groups and the first coupling portion of the other one of the adjacent two of the groups.

4. The frame according to claim 3, wherein at least the first and second coupling portions are formed to curve from the magnetic circuit fixing portion to the diaphragm fixing portion such that thicknesses thereof gradually become thicker or thinner, and are formed such that the thickness of the first coupling portion and the thickness of the second coupling portion are different from each other.

5. The frame according to claim 1, wherein the frame is made of a resin material containing polyphenylene ether-based resin, polystyrene-based resin, and at least one polyolefin-based resin selected from a group consisting of polyethylene, polypropylene, and ethylene-propylene copolymer.

6. A speaker unit comprising:

the frame according to claim 1;

the diaphragm fixed to the diaphragm fixing portion;

a voice coil coupled to the diaphragm;

the terminal fixed to the terminal fixing portion and connected to a coil of the voice coil;

the magnetic circuit having a magnetic gap in which the coil of the voice coil is arranged and fixed to the magnetic circuit fixing portion; and a damping member attached to cover the opening holes.

7. A headphone or an earphone comprising:

the speaker unit according to claim 6.

* * * * *